United States Patent [19]

Norsworthy

[11] Patent Number: 5,042,557

[45] Date of Patent: Aug. 27, 1991

[54] PORTABLE FENCE SYSTEM

[75] Inventor: John A. Norsworthy, Gloucester, Canada

[73] Assignee: Unique-Quality Products, Inc., Alberta, Canada

[21] Appl. No.: 577,098

[22] Filed: Sep. 4, 1990

Related U.S. Application Data

[63] Continuation of Ser. No. 371,533, Jun. 26, 1989, abandoned.

[30] Foreign Application Priority Data

Jul. 5, 1988 [CA] Canada ..... 571193

[51] Int. Cl.[5] ..... A47G 5/00

[52] U.S. Cl. ..... 160/351; 256/1; 256/73

[58] Field of Search ..... 160/351, 350, 135, 380, 160/399, 402; 256/73, 1, 47; 49/380

[56] References Cited

U.S. PATENT DOCUMENTS

| | | | |
|---|---|---|---|
| 33,937 | 12/1861 | Foote | 256/1 |
| 236,971 | 1/1881 | Bahnson | 256/73 X |
| 263,033 | 8/1882 | Enos | 256/73 X |
| 353,130 | 11/1886 | Gholson | 256/1 |
| 1,210,547 | 1/1917 | Schutt | 256/1 |
| 1,546,300 | 7/1925 | Mann | 256/1 |
| 2,499,859 | 3/1950 | Halter | 160/351 X |
| 2,534,410 | 12/1950 | Brickman | 256/47 |
| 4,067,547 | 1/1978 | Peters | 256/73 X |
| 4,083,535 | 4/1978 | Britt | 256/73 X |
| 4,145,031 | 3/1979 | Baker | 256/73 X |
| 4,193,533 | 3/1980 | Witt | 256/11 |
| 4,339,114 | 7/1982 | Deike | 256/73 X |
| 4,903,947 | 2/1990 | Groves | 256/1 X |

*Primary Examiner*—David M. Purol

*Attorney, Agent, or Firm*—Mason, Fenwick & Lawrence

[57] ABSTRACT

There is provided a new and useful gate structure for use in a confinement area, the structure comprising a frame adapted to releasably retain the ends of a length or lengths of fence, a door pivotally mounted in the frame for rotation between open and closed positions, and a base carrying the frame for retaining the frame and the door in a vertical orientation when in use.

10 Claims, 7 Drawing Sheets

PORTABLE FENCE SYSTEM

This application is a continuation of U.S. Pat. Application Ser. No. 371,533, filed June 26, 1989, now abandoned.

This invention relates to a fence system, and in particular to a fence system for confining domestic pets.

BACKGROUND OF THE INVENTION

Travelling with pets even a short distance from home can cause confinement problems. Not all persons are pet lovers, and not all persons want other people's pets in their homes. One solution to the problem is to leave the pet outside tied to a tree or another fixed object. However, this solution is decidedly unsatisfactory, and may lead to other problems. For example, a tethered animal may fall prey to a stray. Accordingly, a need exists for a portable confinement or fence system.

The object of the present invention is to meet the above need by providing a relatively simple, readily portable gate structure for use with a length or lengths of fence to form a confinement area.

Accordingly, the invention provides a gate structure for use in a confinement area, the structure comprising frame means having means for releasably retaining the ends of a length or lengths of fence, door means pivotally mounted in the frame means for rotation between open and closed positions, and base means carrying the frame means for retaining the frame means and the door means in a vertical orientation when in use.

BRIEF DESCRIPTION OF THE DRAWINGS

In drawings which illustrate embodiments of the invention.

Figure 1:
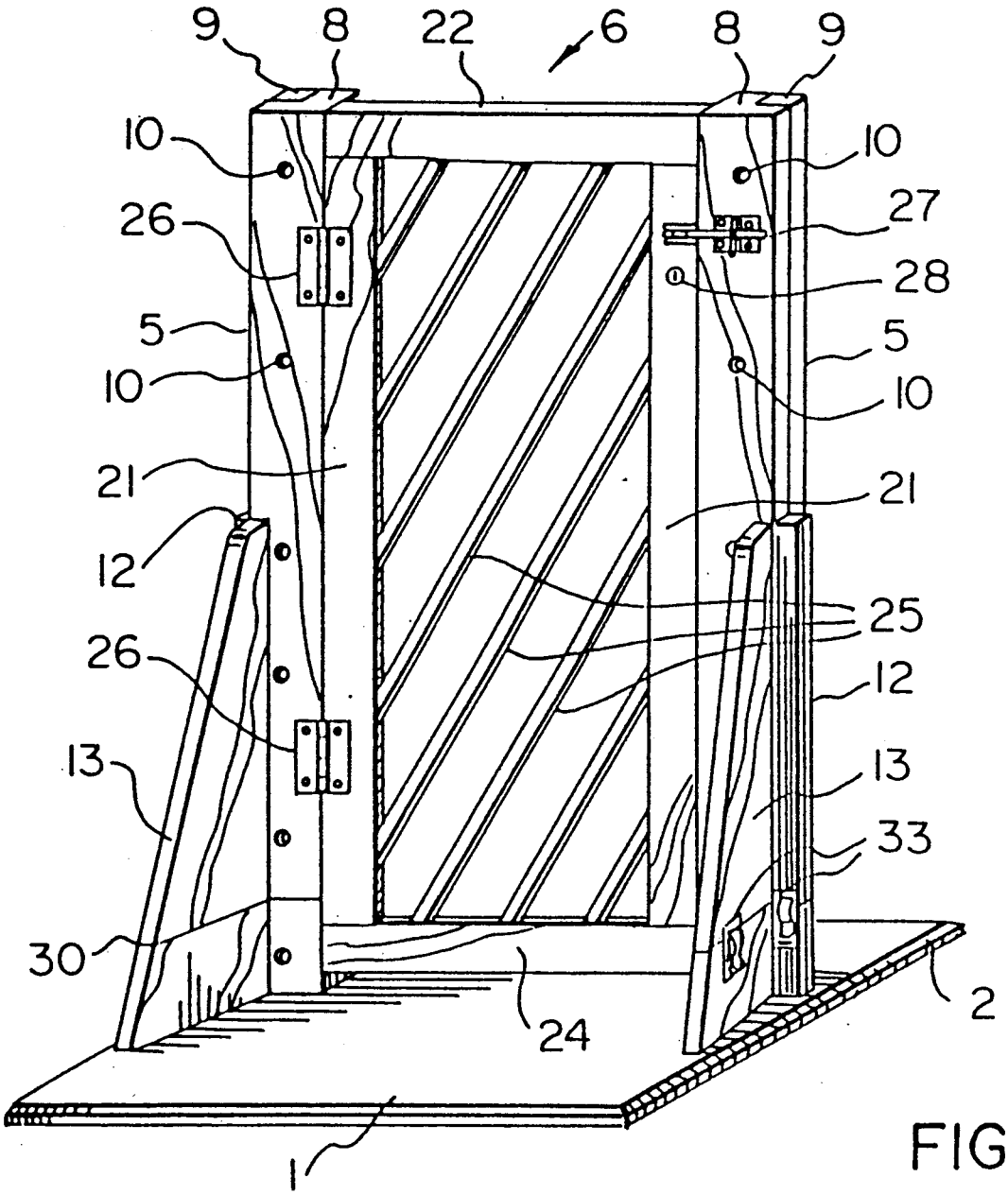
FIG. 1 is a perspective view from above and the first or outer side of a gate structure according to the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

With reference to FIGS. 1 to 6, a portable gate structure for use in a fence system includes a platform means or base 1 with bevelled top edges 2 and a plurality of disc-shaped, rubber feet 3 on the bottom surface thereof. A pair of up rights or posts 5 extend upwardly from the sides of the base for supporting a door generally indicated at 6. Each post is defined by two sections, namely a main section 8 of L-shaped cross section, and a retainer section 9 of rectangular cross section, the two sections 8 and 9 fitting together to define a post of rectangular cross section. Carriage bolts 10 extend through the sections 8 and 9 from the front to the rear thereof for receiving nuts 11 (FIG. 2) whereby the two sections are releasably interconnected. The sections 8 and 9 thus form means for releasably retaining the ends of a length or lengths of fence between them. The posts 5 are stabilized on the base 1 by vertical, reinforcing, side bars 12 and truncated triangular gussets 13. A screw 15 (FIG. 4) extends upwardly through the base at each end of an elongated groove 16 into the bottom of a post 8. Chains 18 and a turnbuckle 19 interconnect the screws 15 for effecting slight variations in the distance between the posts 8, i.e. for varying the width of the opening for receiving the door 6.

Figure 3:
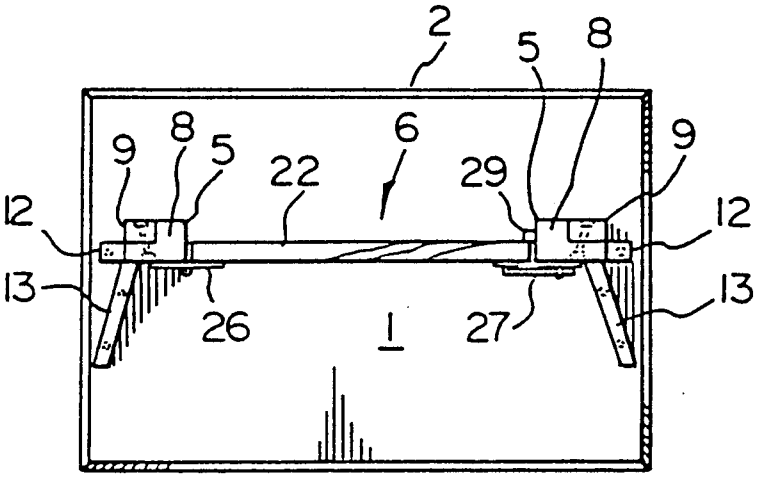
FIG. 3 is a plan view of the structure of FIGS. 1 and 2.
Figure 2:
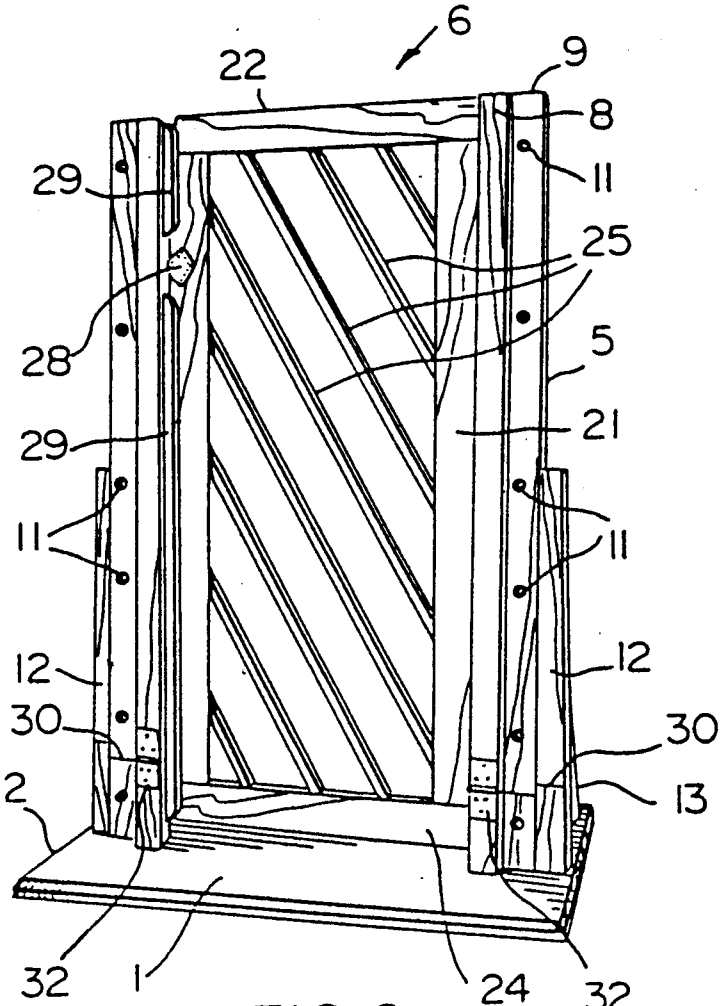
FIG. 2 is a perspective view from the rear or inside of the gate structure of FIG. 1.
Figure 5:
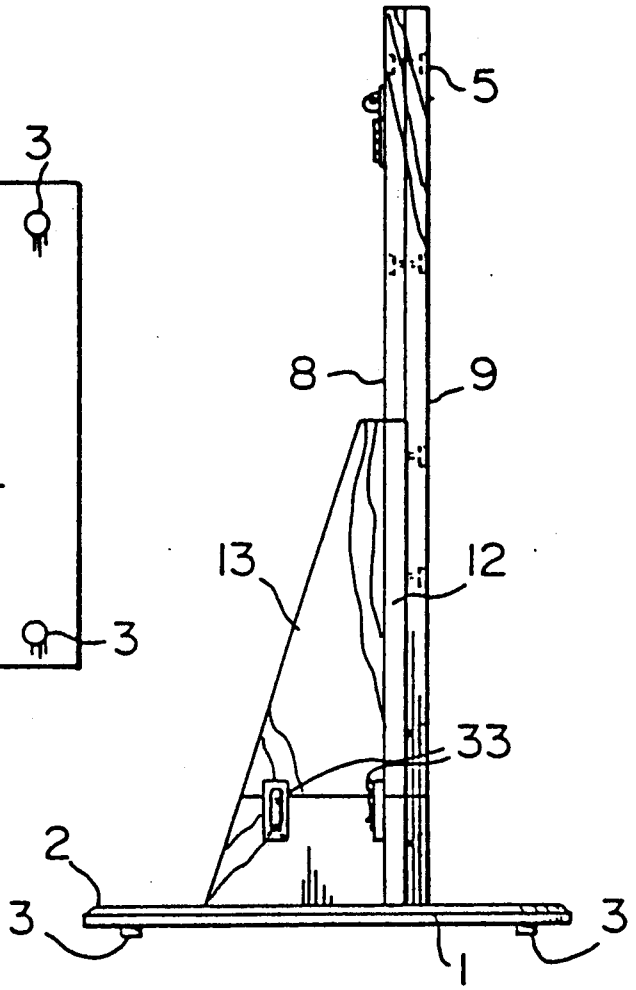
FIG. 5 a side elevational view of the structure of FIGS. 1 to 4.
Figure 4:
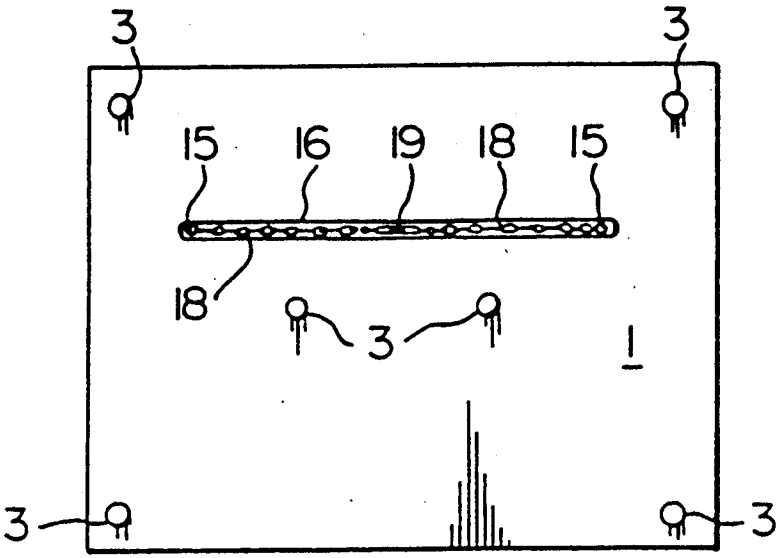
FIG. 4 is a bottom view of the structure of FIGS. 1 to 3.

The door 6 includes a rectangular border defined by straight sides 21, a top end 22 and a bottom end 24. Diagonal bars 25 extend between the sides and ends. Hinges 26 are used to pivotally mount the door 6 on one of the posts 5. A latch 27 of the type conventionally used on gates in fences is mounted on the other post 5 and one side 21 of the door 6 for releasably retaining the latter in the closed position. A simple lock 28 of the drawerlock type, which is operated with a key is also mounted in the door side 21 beneath the latch 27. Movement of the door 6 beyond the closed position is prevented by stops defined by wooden strips 29 (FIGS. 2 and 3).

Figure 6:
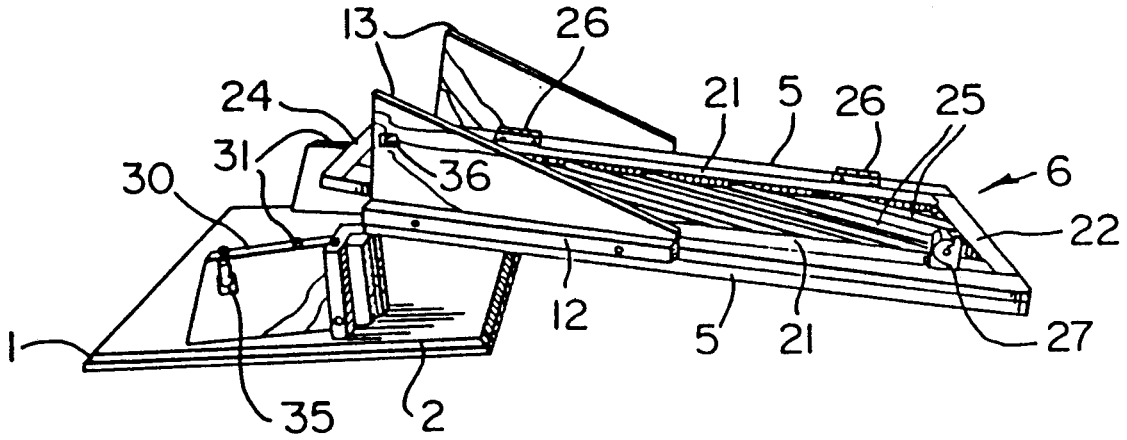
FIG. 6 is a perspective view from one side of the structure of 1 to 5 in the collapsed condition.

The door frame (i.e. the posts 5, the reinforcing bars 12 and the gussets 13) is split horizontally near the base 1 by a slit 30. Dowels or pins 31 (FIG. 6) are provided on the bottom section of the gusset 13 for mating with recesses (not shown) in the top section of the gusset. The two sections of frame are pivotally interconnected by a pair of hinges 32 (FIG. 2) mounted on the inside of the main sections 8 of the posts 5. Thus the posts 5 and the gate 6 can be rotated between the vertical, use position (FIGS. 1 to 3 and 5) and the collapsed, carrying, non-use or transport position (FIG. 6). The two sections of the frame are retained in the vertical, use position by latches 33 of suitcase hasp-type, i.e. latches of the type including a lever-operated loop 35 (FIG. 6) on one element for engaging a grooved lug 36 on a second element.

Figure 7:
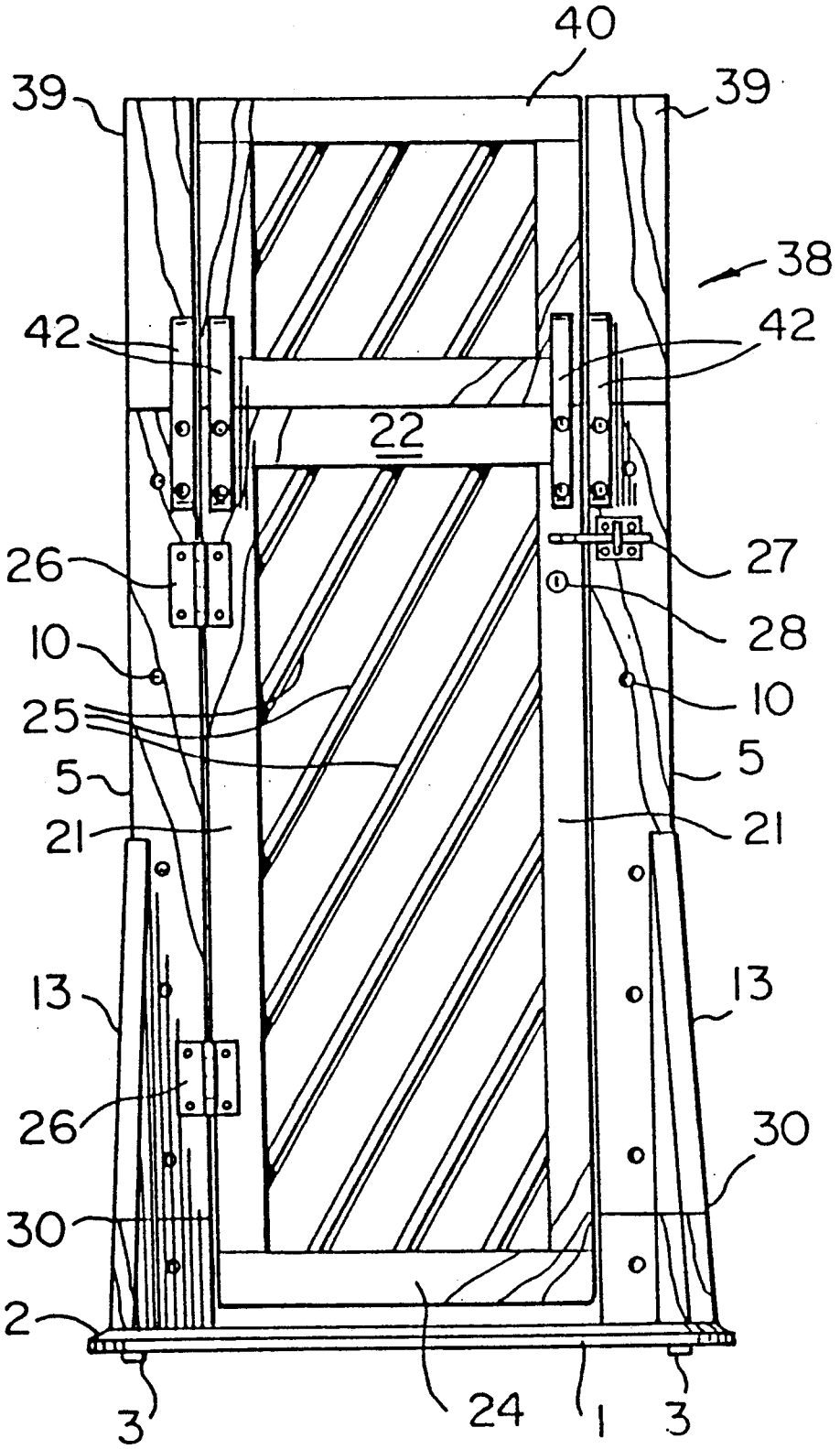
FIG. 7 is a front view of the gate structure of FIGS. 1 to 5 with an e added thereto.
Figure 8:
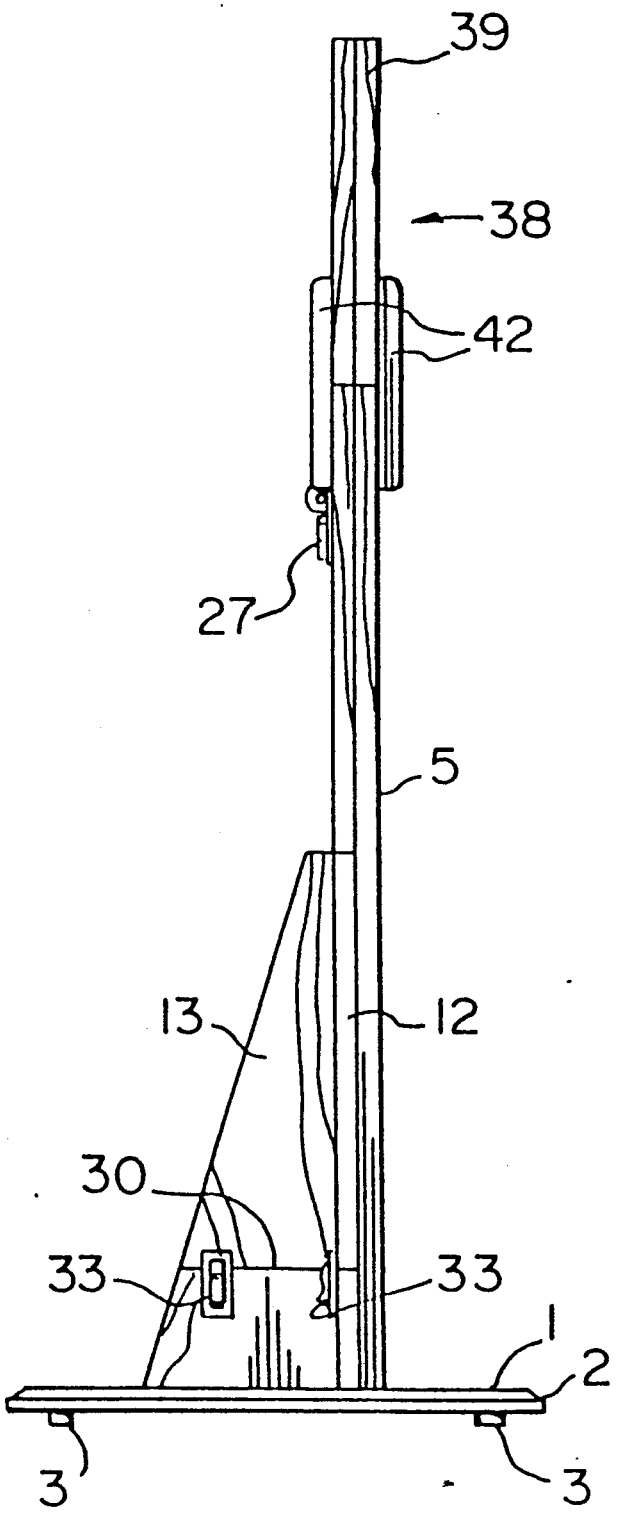
FIG. 8 is a side elevational view of the structure of FIG. 7.

Referring to FIGS. 7 and 8, a taller gate can readily be formed by mounting an extension generally indicated at 38 on top of the posts 5 and the gate 6. The extension 38 includes post sections 39 and a gate section 40, which are structurally similar to the posts 5 and the gate 6. The sections 39 and 40 are mounted on the posts 5 and the gate 6, respectively by means of brackets defined by bars 42 bolted to and extending upwardly from the front and rear of each post 5 and the gate 6 for overlapping the bottom ends of the sections 39 and 40.

Figure 9:
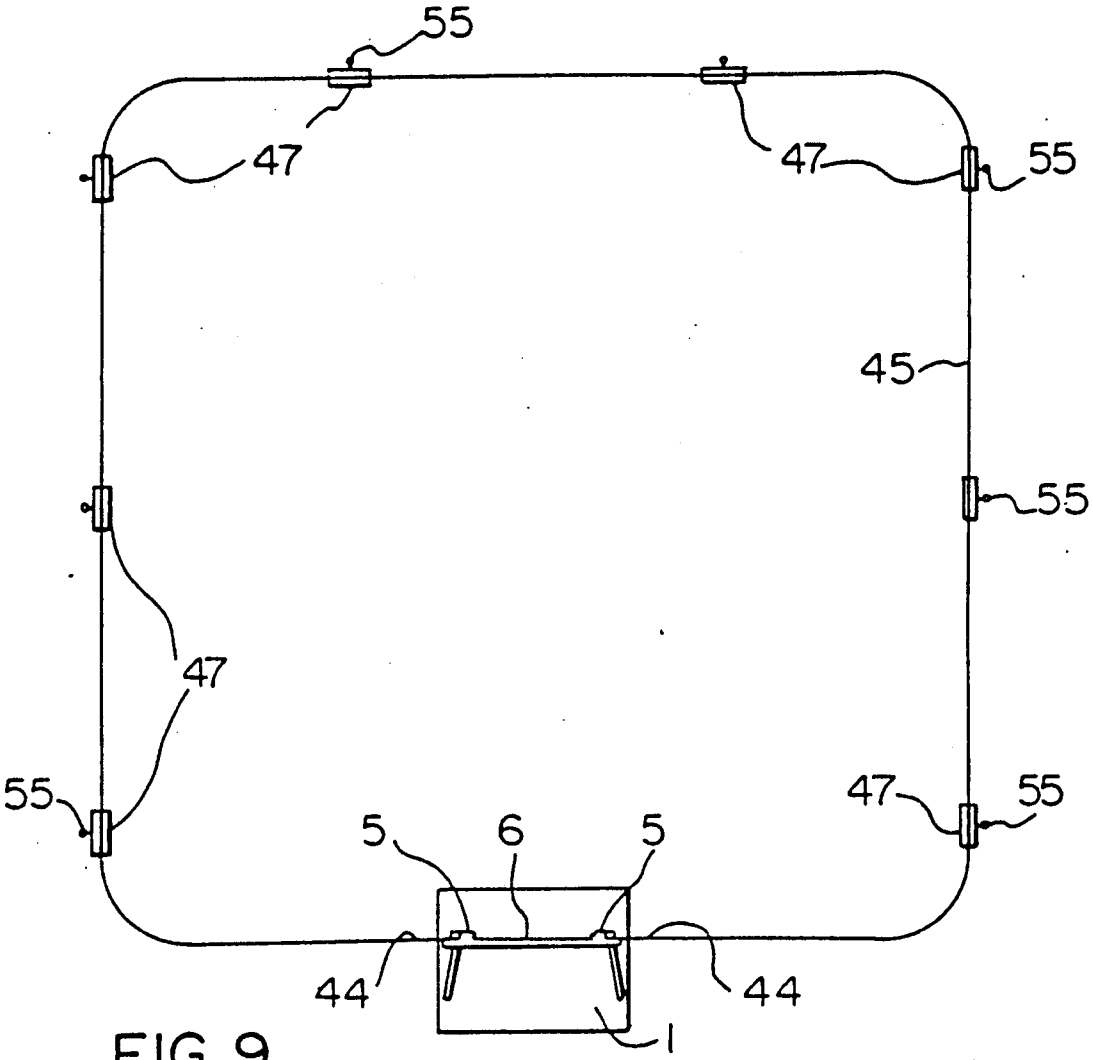
FIG. 9 is a schematic plan view of a fence system incorporating the structure of FIGS. 1 to 8.

In use (FIG. 9), the ends 44 of a length of self-supporting wire mesh fence 45 are connected to the posts 5 to define an enclosure. For such purpose, the retainer sections 9 of the post are separated from the sections 8, the ends 44 of the fence are placed against the sections 8 and the retainer sections 9 are replaced to sandwich the fence between the post sections.

Figure 10:
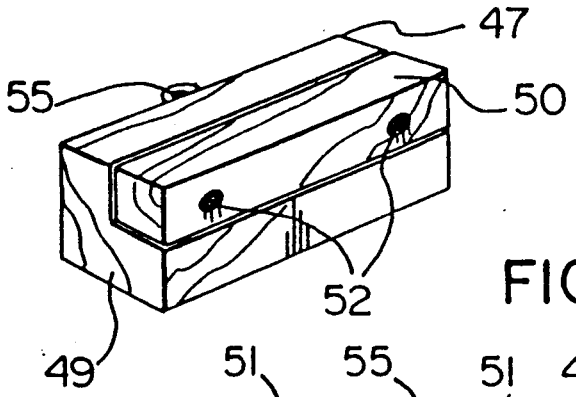
FIG. 10 which is located on the fourth sheet of drawings, is a perspective view from the top and one end of a bracket for use with the gate structure of the present invention.
Figure 11:
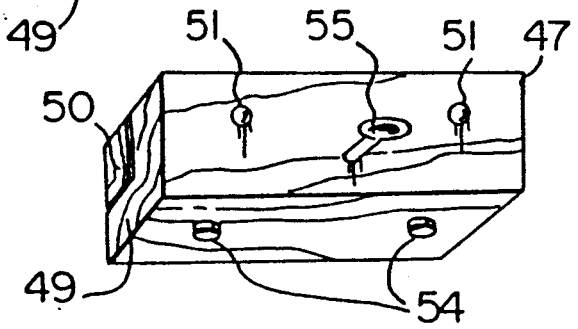
FIG. 11, which is located on the fourth sheet of drawings, is a perspective view from the bottom and the other end of the bracket of FIG. 10.

The fence 45 is anchored to the ground using a series of separate bracket means such as brackets 47 (FIGS. 10 and 11). The brackets 47 include a base 49 of L-shaped cross section, and a square cross section top or clamp section 50. The bottom edge of the fence 45 is clamped between the two sections 49 and 50, which are tied together by carriage bolts 51 and nuts 52. Ground engaging, disc-shaped feet 54 are provided on the bottom surface of the base 49 loop means preferably comprising. An eyebolt 55 is mounted in the outer side of the base 49 for receiving a ground anchor (not shown) for anchoring the fence 45 to the ground, or other installation surface.

In use, the entire fence system, except for the length of fence, can be carried from location to location in a large, compartmented bag (not shown), and easily assembled in a short period of time. Since all of the bolts and nuts used to interconnect the post sections 8 and 9, and the bracket sections 49 and 50 are the same size, the only tool required is a nut driver (not shown) which would be provided with the system. By using the extension 38 and a higher length of fencing, the system can be adapted to large dogs.

While the fence system has been described for use with domestic pets, it will be appreciated that the system could be used for confining children. Moreover, the system can be used indoors or outdoors, and to fence off portions of construction sites, areas in trade, dog, auto or boat shows, or even on a farm for confining goats, sheep, hogs or fowl.

When used on a hard surface, which cannot be penetrated by ground anchors, the brackets 47 are weighted or otherwise anchored to the surface.

Thus it is apparent that there has been provided in accordance with the invention a portable fence system that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A self-supporting portable gate structure for use in a confinement area, said gate structure comprising:

door means rotatable between opened and closed positions for opening and closing said gate structure and self-supporting support means for mounting said door means, said support means comprising a single base member for resting on a support surface and frame means carried by said single base member for mounting said door means and for releasably retaining the ends of a length or lengths of fence, said frame means comprising first and second uprights fixedly and nonrotatably mounted on said single base member on each side of said door means when in the use position, said door means being rotatably mounted on one of said uprights.

2. The gate structure of claim 1, said single base member extending between said uprights.

3. The gate structure of claim 2, said single base member between said uprights also extending beneath, in front of and behind said door means when said door means is in the closed position.

4. The gate structure of claim 1, wherein said frame means further comprises diagonal braces extending between said uprights and said single base member on each side of said door means.

5. The gate structure according to claim 1, wherein said frame means is sectional for folding between an erect, use position and a collapsed, transport position.

6. A gate structure according to claim 1, including a series of separate bracket means for engaging the bottom of a length of fence and receiving ground anchors for securing the fence to the ground.

7. A gate structure according to claim 1, including extension means for mounting on said frame means and door extension means for mounting on said door means for use with a high length of fence to form a high walled confinement area.

8. A self-supporting confinement area comprising a self-supporting portable gate structure and a length of fence, said gate structure comprising:

door means rotatable between opened and closed positions for opening and closing said gate structure and self-supporting support means for mounting said door means, said support means comprising a single base member for resting on a support surface and frame means carried by said single base member for mounting said door means and for releasably retaining the ends of a length or lengths of fence, said frame means comprising first and second uprights fixedly and nonrotatably mounted on said single base member on each side of said door means when in the use position, said door means being rotatably mounted on one of said uprights; and said length of fence including first and second ends adapted to be releasably retained by said frame means.

9. A self-supporting gate structure for use in a confinement area, said structure comprising frame means having means for releasably retaining the ends of a length or lengths of fence, door means pivotally mounted in said frame means for rotation between closed and open positions, and base means carrying said frame means for retaining said frame means and said door means in a vertical orientation when in use, wherein said base means includes platform means extending beneath, in front of and behind said door means when said door means is in the closed position, wherein said frame means includes uprights fixedly mounted on said base means on each side of said door means, and diagonal braces extending between said uprights and said platform means on each side of said door means, and wherein each said upright includes a first main section attached to said base means, and a second movable section for clamping an end of a length of fence against a fixed section.

10. A self-supporting gate structure for use in a confinement area, said structure comprising frame means having means for releasably retaining the ends of a length or lengths of fence, door means pivotally mounted in said frame means for rotation between closed and open positions, base means carrying said frame means for retaining said frame means and said door means in a vertical orientation when in use, and a series of separate bracket means for engaging the bottom of a length of fence and receiving ground anchors for securing the fence to the ground, wherein each said bracket means includes a pair of releasably interconnected elements for securing a bottom edge of the length of fence therebetween, and loop means extending outwardly from one said element for receiving a ground anchor.

* * * * *